US012091789B2

(12) United States Patent
Lonati et al.

(10) Patent No.: US 12,091,789 B2
(45) Date of Patent: Sep. 17, 2024

(54) REMOVAL DEVICE FOR REMOVING A KNITTED TUBULAR MANUFACTURE FROM A CIRCULAR KNITTING MACHINE FOR HOSIERY OR THE LIKE

(71) Applicant: Lonati S.P.A, Brescia (IT)

(72) Inventors: Ettore Lonati, Botticino (IT); Fausto Lonati, Brescia (IT); Francesco Lonati, San Felice del Benaco (IT)

(73) Assignee: Lonati S.P.A., Brescia (IT)

( * ) Notice: Subject to any disclaimer, the term of this patent is extended or adjusted under 35 U.S.C. 154(b) by 0 days.

(21) Appl. No.: 17/642,037

(22) PCT Filed: Mar. 3, 2020

(86) PCT No.: PCT/EP2020/084545
§ 371 (c)(1),
(2) Date: Mar. 10, 2022

(87) PCT Pub. No.: WO2021/115933
PCT Pub. Date: Jun. 17, 2021

(65) Prior Publication Data

US 2024/0044055 A1 Feb. 8, 2024

(30) Foreign Application Priority Data

Dec. 10, 2019 (IT) ..... 102019000023433

(51) Int. Cl.
*D04B 9/40* (2006.01)
*D04B 1/26* (2006.01)
(Continued)

(52) U.S. Cl.
CPC ..... *D04B 9/40* (2013.01); *D04B 1/26* (2013.01); *D04B 15/02* (2013.01); *D04B 15/14* (2013.01); *D04B 15/88* (2013.01); *D04B 9/46* (2013.01)

(58) Field of Classification Search
CPC . D04B 9/40; D04B 9/46; D04B 15/02; D04B 15/14; D04B 15/88
See application file for complete search history.

(56) References Cited

U.S. PATENT DOCUMENTS 2,895,317 A 7/1959 Miller et al.
4,116,021 A 9/1978 Harrill
(Continued)

FOREIGN PATENT DOCUMENTS

CN 102046783 A 5/2011
CN 108350630 A 7/2018
(Continued)

OTHER PUBLICATIONS

International Search Report for IT201900023433 dated Aug. 11, 2020.
(Continued)

*Primary Examiner* — Aiying Zhao
(74) *Attorney, Agent, or Firm* — Quicker Law, LLC

(57) ABSTRACT

A removal device for removing a knitted tubular manufacture from a circular knitting machine, comprising an annular removal body which supports a plurality of removal members arranged around the axis of the removal body, the removal body being arrangeable coaxially around the needle cylinder of a circular knitting machine, wherein the removal members are supported by a first annular portion and a second annular portion which can rotate with respect to each other about an oscillation axis to pass between a removal condition, in which they are arranged so as to form a circumference that is coaxial with the axis of the removal device, and a sewing condition, in which the annular portions are arranged so as to face each other.

8 Claims, 12 Drawing Sheets

(51) Int. Cl.

| | |
|---|---|
| ***D04B 9/46*** | (2006.01) |
| ***D04B 15/02*** | (2006.01) |
| ***D04B 15/14*** | (2006.01) |
| ***D04B 15/88*** | (2006.01) |

(56) References Cited

U.S. PATENT DOCUMENTS

| | | | | |
|---|---|---|---|---|
| 4,250,723 | A | 2/1981 | Harrill | |
| 5,761,931 | A * | 6/1998 | Lonati | D04B 9/56 66/58 |
| 6,164,091 | A * | 12/2000 | Frullini | D04B 9/40 66/58 |
| 6,381,991 | B2 | 5/2002 | Ando | |
| 2001/0017047 | A1 * | 8/2001 | Ando' | D04B 15/02 66/58 |
| 2001/0052248 | A1 * | 12/2001 | Ando' | D04B 9/40 66/49 |
| 2003/0074929 | A1 * | 4/2003 | Jurgens | D04B 15/02 66/147 |
| 2006/0144095 | A1 * | 7/2006 | Frullini | D04B 15/18 66/8 |
| 2016/0024695 | A1 * | 1/2016 | Conti | D04B 9/40 66/58 |
| 2017/0241052 | A1 * | 8/2017 | Conti | D04B 15/02 |
| 2018/0002844 | A1 | 1/2018 | Lonati et al. | |

FOREIGN PATENT DOCUMENTS

| | | | | |
|---|---|---|---|---|
| EP | 1127971 | A2 | 8/2001 | |
| EP | 1579046 | A1 | 9/2005 | |
| EP | 2984220 | A1 | 2/2016 | |
| WO | WO-2017067801 | A1 * | 4/2017 | D04B 15/02 |

OTHER PUBLICATIONS

Office Action re Indian Application No. IN 202237020819, dated Sep. 27, 2022.

English Translation of Office Action mailed Oct. 24, 2023 in Egyptian Application 2022040538 (8 pgs.).

English Translation of Office Action mailed Apr. 9, 2024 in Egyptian Application 2022040538 (6 pgs.).

English Translation of Office Action mailed Mar. 26, 2024 in Brazil application BR 112022008120-0 (4 pgs.).

Office Action mailed Jan. 24, 2024 in Colombian Application No. NC2022/0001041 with English translation (16 pgs.).

* cited by examiner

REMOVAL DEVICE FOR REMOVING A KNITTED TUBULAR MANUFACTURE FROM A CIRCULAR KNITTING MACHINE FOR HOSIERY OR THE LIKE

CROSS-REFERENCE TO RELATED APPLICATIONS

This application is a national phase entry of International Application No. PCT/EP2020/084545 filed Mar. 3, 2020; which claims priority to Italian Application No. 102019000023433 filed Dec. 10, 2019; the disclosures of both of which are incorporated by reference herein in their entirety.

FIELD OF THE DISCLOSURE

The present invention relates to a removal device for removing a tubular knitted manufacture from a circular knitting machine for hosiery or the like.

BACKGROUND

In the field of the production of tubular knitted manufactures with circular knitting machines for hosiery or the like, in some cases there is the need to perform a transfer of the manufacture from the machine used for the production of the manufacture to another production unit in order to perform further work on the manufacture that cannot be performed on said machine or that is not economically convenient to be performed on said machine.

In particular, in the field of the production of hosiery, in recent years techniques for performing automatically the closing of the toe, by sewing or looping, have been developed. Some of these techniques are based on the removal of the manufacture from the machine used for its production and on its transfer to a station for further work, separate from the production machine, so as to close the toe of the hosiery item in the station for further work while the machine is used for the production of another hosiery item. These techniques have the advantage, with respect to other techniques that are based on closing the toe of the hosiery item directly on the machine used for its production, of not impairing excessively the productivity of the machine.

The transfer of the hosiery item, or more in general of the tubular manufacture, from the machine used for its production to the station in which the closing of an axial end of the manufacture is to be performed, or more in general a further processing of the manufacture is generally performed by means of a removal device which, by means of removal members, picks up individually the loops of knitting of the manufacture from the needles of the machine and holds them during the transfer of the manufacture.

In some techniques for closing the toe of hosiery items, the removal device is used also to support the manufacture during the execution of the further work, while in other techniques the removal device is used only to transfer the manufacture since, once it has reached the station in which the further work has to be performed, it releases, usually still individually, the loops of knitting, previously removed from the needles, to another device which has the function of supporting the manufacture during the performance of the further work, such as for example a handling device. The handling device makes the loops belonging to one half of the course of knitting received by the removal device face the loops belonging to the other half of the same course of knitting and supports the two half-courses of knitting in a mutually facing position during the intervention of a sewing or looping head which joins the mutually facing pairs of loops of knitting.

In removal devices of the known type used in order to simply transfer the manufacture from the machine that has produced it to a handling device, the coupling between the removal members and the needles, in order to transfer the loops of knitting from the needles to the removal members, usually occurs by means of the insertion of the needle head in a seat formed in the end of the removal member. For this reason, the removal device usually has an annular removal body, which is designed to face coaxially the end of the needle cylinder from which the needle heads protrude and supports a plurality of removal members that are oriented parallel to the axis of the removal body.

A removal device of this type is described, for example, in EP0942086 B1.

SUMMARY

The aim of the present invention is to provide a removal device for removing a tubular knitted manufacture from a circular knitting machine for hosiery or the like that has high safety against the accidental disengagement of loops of knitting from the removal members.

Within this aim, an object of the invention is to provide a device that has in any case a high structural simplicity and ensures excellent precision in the coupling of the removal members with the needles of the machine used to produce the manufacture.

Another object of the invention is to provide a removal device that can have a particularly low radial volume.

Another object of the invention is to provide a removal device that can also obviate the radial position errors of the needles of the machine used to produce the manufacture.

Yet another object of the invention is to provide a device that ensures high reliability in use.

The aim of the present invention is to provide a removal device for removing a tubular knitted manufacture from a circular knitting machine for hosiery or the like that is capable of improving the background art in one or more of the aspects mentioned above.

Another object of the invention is to provide a removal device for removing a tubular knitted manufacture from a circular knitting machine for hosiery or the like that is highly reliable, relatively easy to provide and at competitive costs.

This aim and these and other objects which will become more apparent hereinafter are achieved by a removal device for removing a tubular knitted manufacture from a circular knitting machine for hosiery or the like, according to claim 1, optionally provided with one or more of the characteristics of the dependent claims.

BRIEF DESCRIPTION OF ILLUSTRATIVE DRAWINGS

Further characteristics and advantages of the invention will become more apparent from the description of some preferred but not exclusive embodiments of the removal device for removing a tubular knitted manufacture from a circular knitting machine for hosiery or the like, according to the invention, illustrated by way of non-limiting example in the accompanying drawings, wherein.

DETAILED DESCRIPTION OF ILLUSTRATIVE ASPECTS

Figure 1:
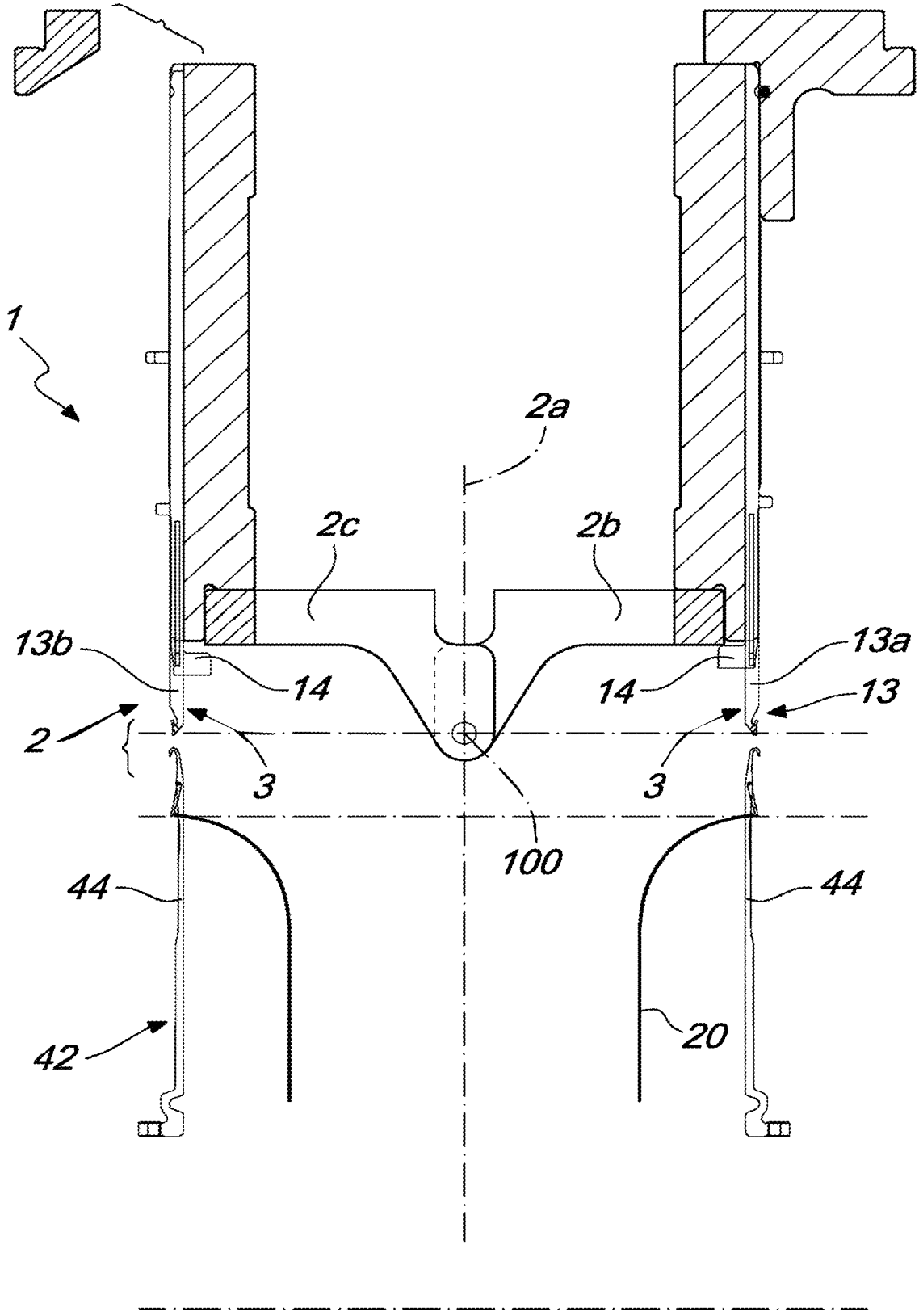
FIG. 1 is a diametrical sectional view of the removal device in disengagement from the needle cylinder.
Figure 2:
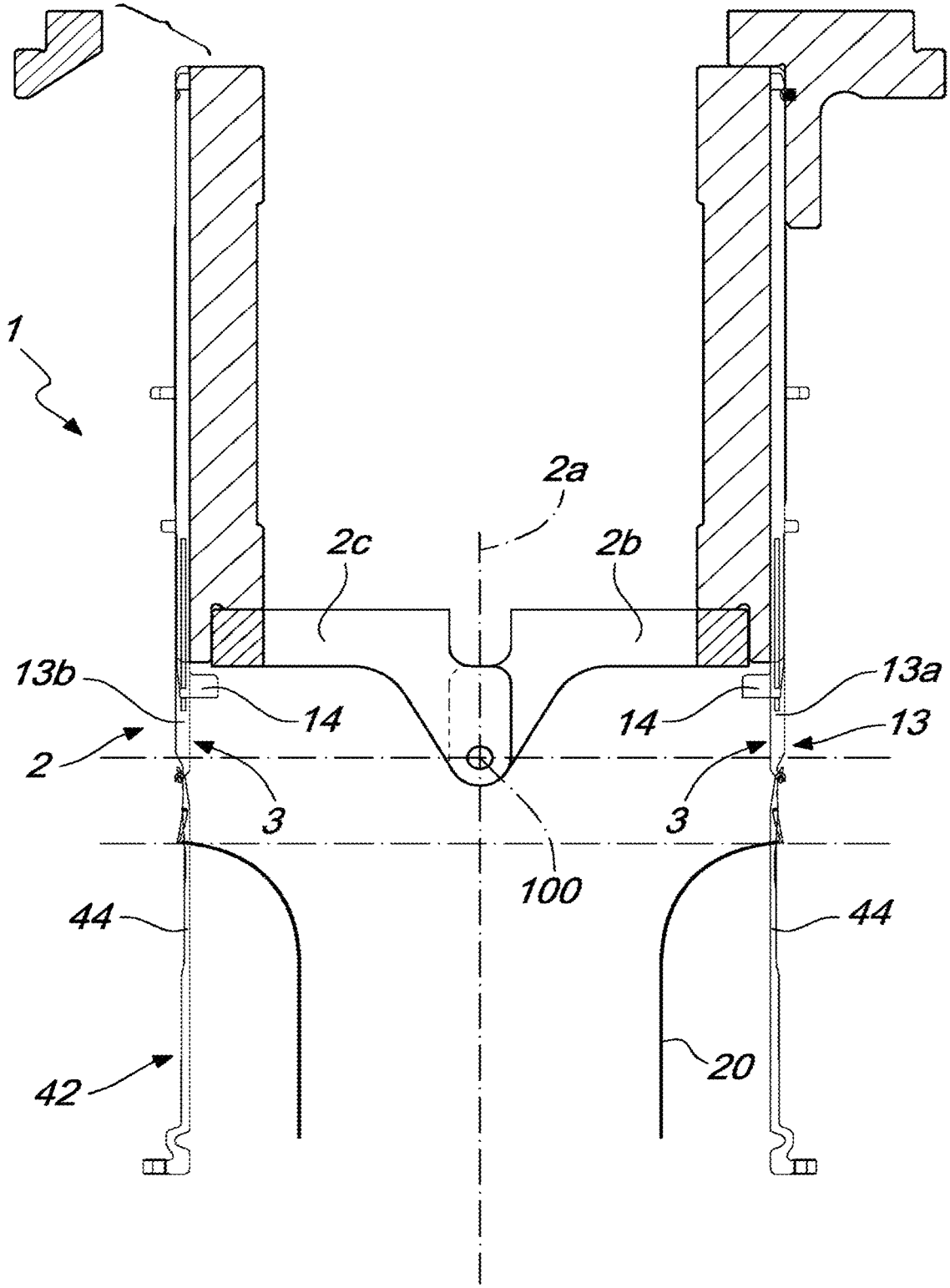
FIG. 2 is a diametrical sectional view of the removal device in the step of engagement with the needles of the needle cylinder.
Figure 3:
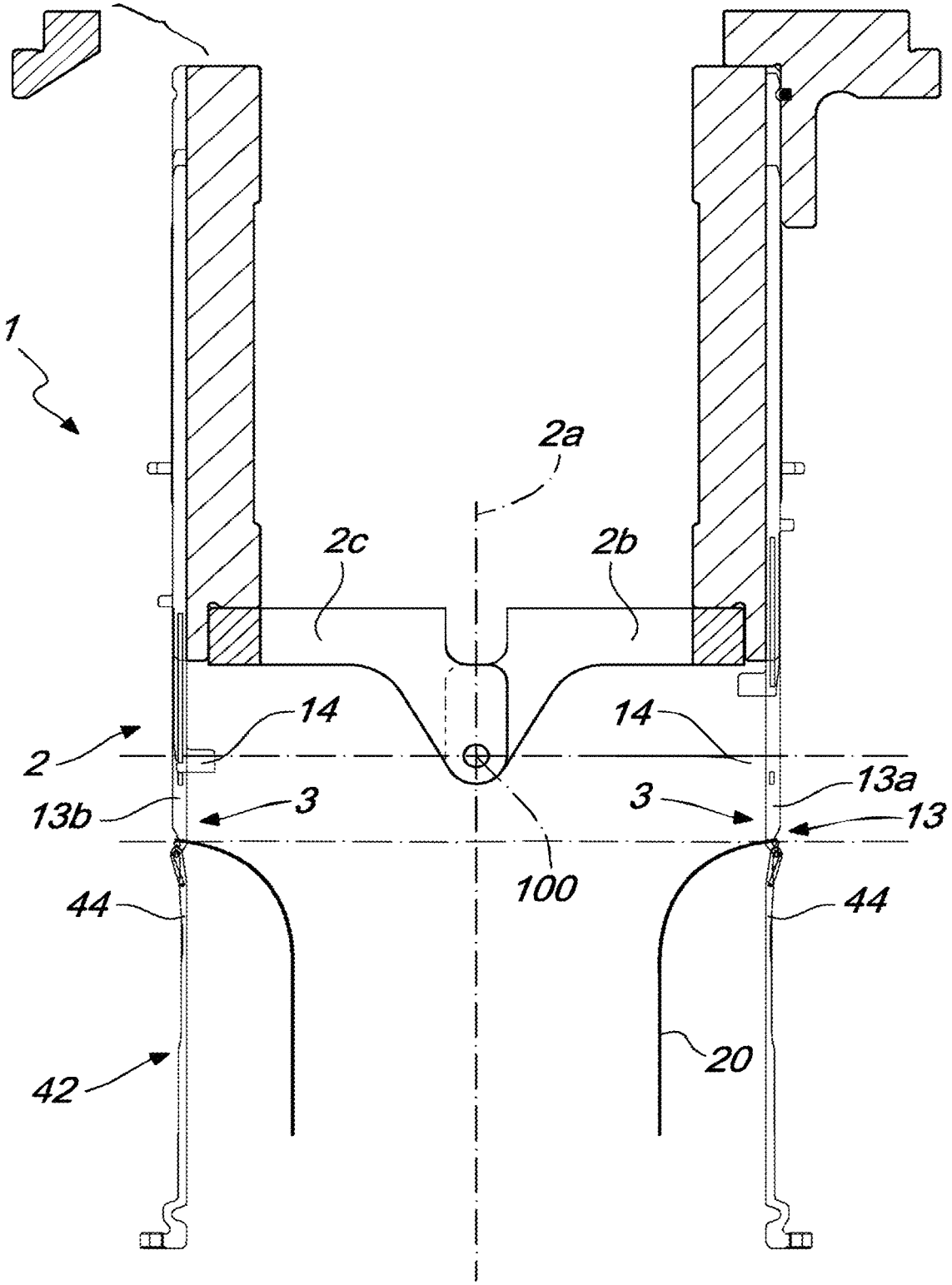
FIG. 3 is a diametrical sectional view of the removal device in the step of transferring the loops of knitting to the removal device.
Figure 4:
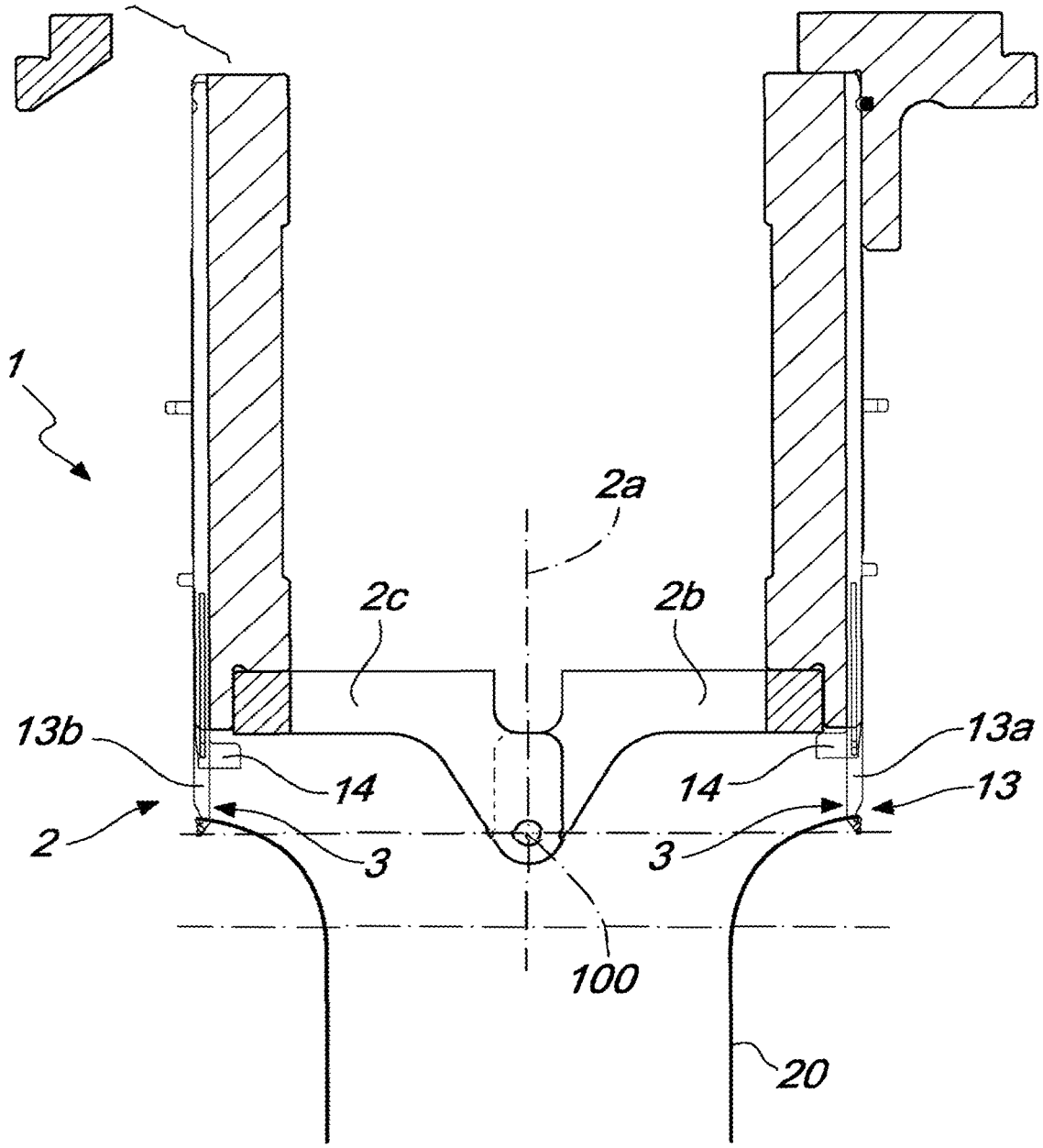
FIG. 4 is a diametrical sectional view of the removal device with the loops of knitting completely transferred.

With reference to the figures, the removal device according to the invention, generally designated by the reference numeral 1, is adapted to remove a knitted tubular manufacture 20 from a circular knitting machine for hosiery or the like.

The removal device 1 comprises an annular removal body 2 which supports a plurality of removal members 3 arranged around the axis 2*a* of the removal body 2.

The removal body 2 is configured to be arranged coaxially around the needle cylinder 42 of a circular knitting machine for hosiery or the like with each one of the removal members 3 arranged so as to correspond to a respective needle 44 of the machine.

The removal members 3 are supported by first and second annular portions 2*b*, 2*c*.

The first and second annular portions 2*b*, 2*c*, can rotate with respect to each other about an oscillation axis 100 that is substantially perpendicular to the axis 2*a* of the removal device in order to pass between a removal condition (shown in FIGS. 1 to 5), in which they are arranged so as to form a circumference that is coaxial with the axis 2*a* of the removal device, and a sewing condition (shown in FIGS. 6 to 11), in which the annular portions 2*b*, 2*c* are arranged so as to face each other.

The first annular portion 2*b* supports a plurality of first removal members 3*a*.

Figure 12:
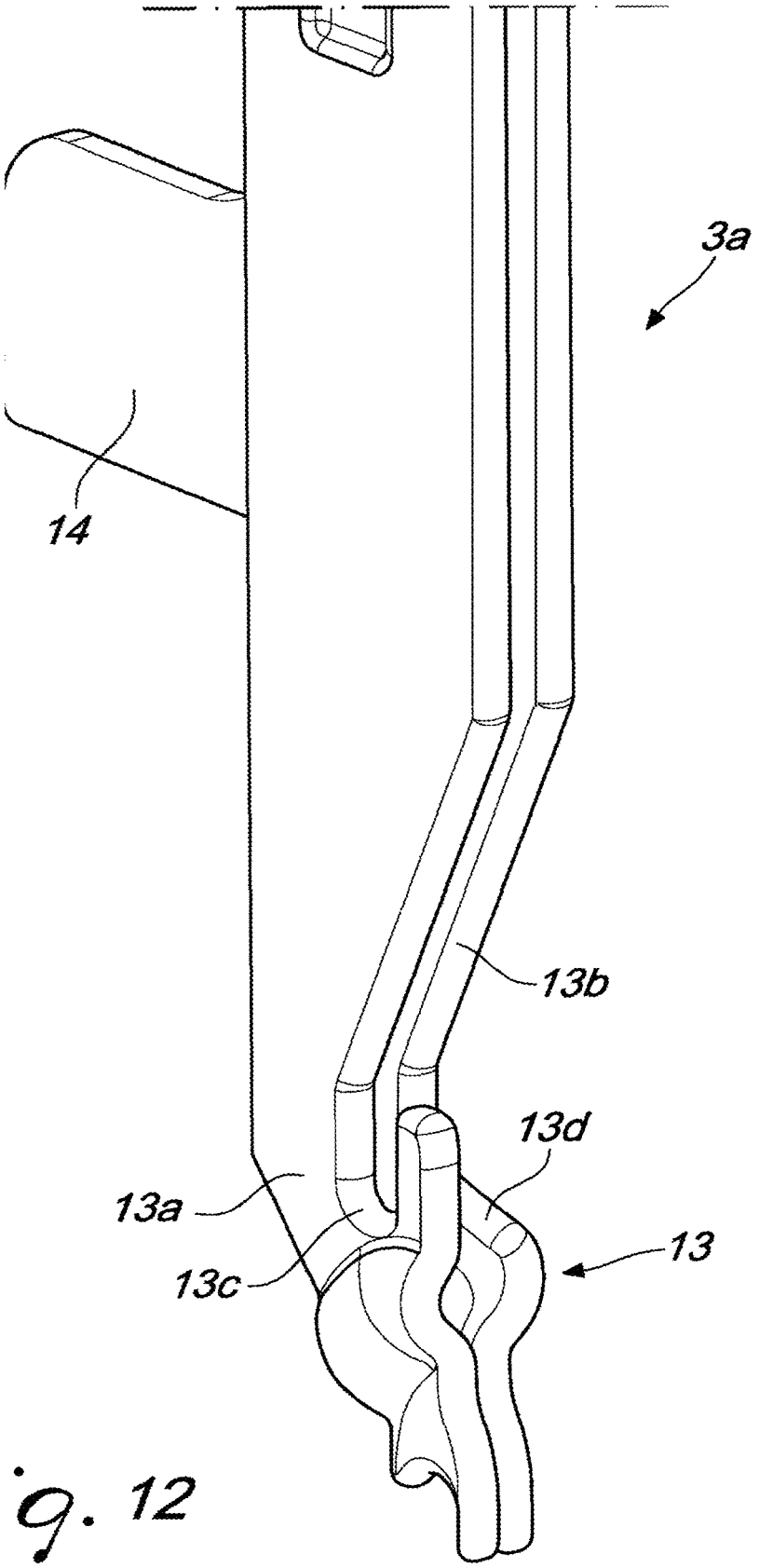
FIG. 12 is a perspective view of the first removal element.

The first removal members 3*a*, shown in enlarged scale in FIG. 12, are each provided with a first and a second removal element 13*a*, 13*b* which are arranged side by side and are designed, during the removal of the respective loop of knitting from the corresponding needle 44, to be arranged on opposite sides with respect to the corresponding needle 44.

The first and second removal elements 13*a*, 13*b* form a removal head 13, which can move with respect to the respective needle 44 along a movement direction that is substantially parallel to the axis 2*a* of the removal body 2.

The first removal element 13*a* forms, at the removal head 13, a hook-shaped portion 13*c*, which is designed to engage and retain the loop of knitting in engagement with the corresponding needle 44.

The second removal element 13*b* comprises, at the removal head 13, an abutment portion 13*d*.

The abutment portion 13*d* in particular can move with respect to the hook-shaped portion 13*c*, in order to disengage from the hook-shaped portion 13*c* the respective loop of knitting.

Conveniently, the abutment portion 13*d* can move with respect to the hook-shaped portion 13*c* along a movement direction that is substantially parallel to the axis 2*a* of the removal device.

Each first removal member 3*a* comprises, moreover, at least one transfer element 14, which can move with respect to the removal head 13 and is designed to transfer the loop of knitting disengaged from the hook-shaped portion 13*c* of the same first removal member 3*a* to a respective second removal member 3*b* with the annular portions 2*b*, 2*c* in the sewing condition.

Conveniently, the transfer element 14 can move with respect to the removal head 13 along a movement direction that is substantially parallel to the axis 2*a* of the removal device.

According to a preferred embodiment, the removal body 2 can rotate on command about the axis 2*a* at the same angular velocity as the needle cylinder 42 during the steps of engagement of each removal member 3*a*, 3*b* with the corresponding needle 44.

This allows the transfer of the loops of knitting from the needle cylinder 42 to the removal member during the step for the provision, by the needles 44, of the last loop of knitting.

Conveniently, the second removal members 3*b* comprise at least second removal elements which form, at a removal head 13, a hook-shaped portion 13*c* designed to engage and retain the loop of knitting in engagement with the corresponding needle 44.

According to a preferred embodiment, the second removal members supported by the second annular portion 2*c* can be shaped in a manner that corresponds to the first removal members 3*a*.

Conveniently, the second removal members 3*b* comprise second removal elements 13*a*, 13*b*, which can move with respect to the respective needle 44 along a movement direction that is substantially parallel to the axis 2*a* of the removal body 2.

Advantageously, the transfer element 14 comprises a pusher lamina arranged between the first and second removal elements (13*a*, 13*b*).

The second removal members 3*b* comprise a transfer element 14, which can move with respect to the respective removal head 13 and is designed to act as abutment for the respective loop of knitting in disengagement from the hook-shaped portion 13*c* of the removal head of the second removal member 3*b*.

According to one embodiment, the removal device 1 comprises selective actuation means for the movement of the first and second removal members 3*a*, 3*b*.

Such selective actuation means, for example, can comprise cam devices designed to move the removal members and the various components that constitute them, such as the removal head 13, the first and second removal elements 13*a*, 13*b* and the transfer element 14.

According to a preferred embodiment, the first and second removal elements 13*a*, 13*b* are arranged side by side and can move away from and toward each other along a direction that is substantially tangential with respect to the axis 2*a* of the removal body 2, following engagement with the respective needle 44.

This allows, in particular, to bring the removal head 13 below the respective loop to be removed.

Moreover, this solution makes it possible to use the removal body 2 regardless the type and shape of needles 44 of the needle cylinder 42.

The operation of the removal device 1, according to the invention, is as follows.

The removal body 2 (FIG. 1) is arranged facing and in axial alignment with the needle cylinder 42, with the annular portions in the removal condition.

The removal body 2 is rotated about its own axis 2*a* at the same rotation rate as the needle cylinder 42.

Once the needle cylinder 42 has finished the forming of the tubular manufacture 20, suitable cam devices selectively actuate the lowering of the removal members 3 toward the respective needle 44.

The respective removal heads 13 (FIG. 2), by lowering, cause the engagement of the hook of the respective needle 44 and, by continuing in their lowering movement (FIG. 3), drag the loop of knitting to the hook-shaped portion 13*c*.

Figure 5:
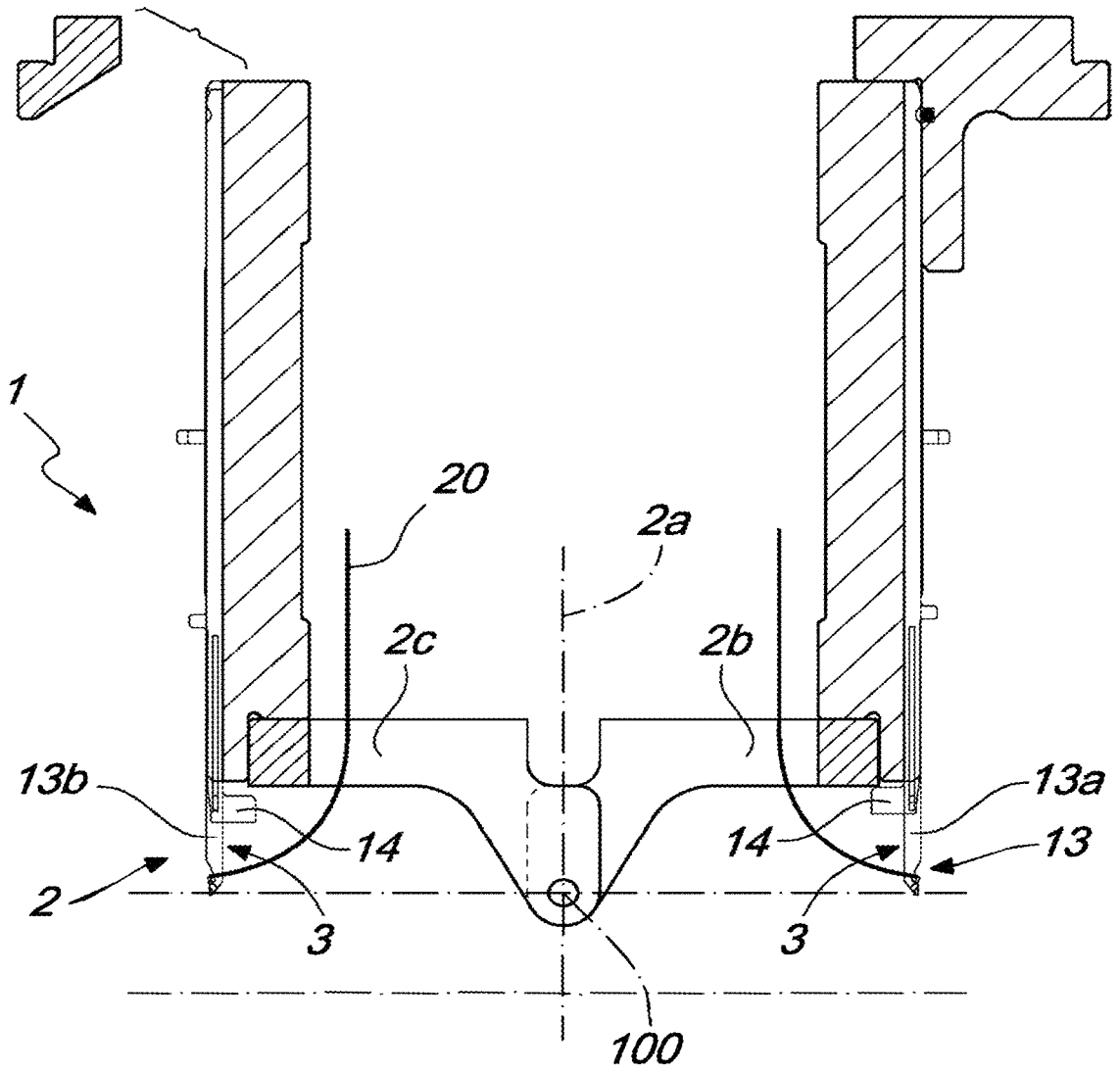
FIG. 5 is a diametrical sectional view of the removal device in the condition of FIG. 4 and with the hosiery item inside out.
Figure 6:
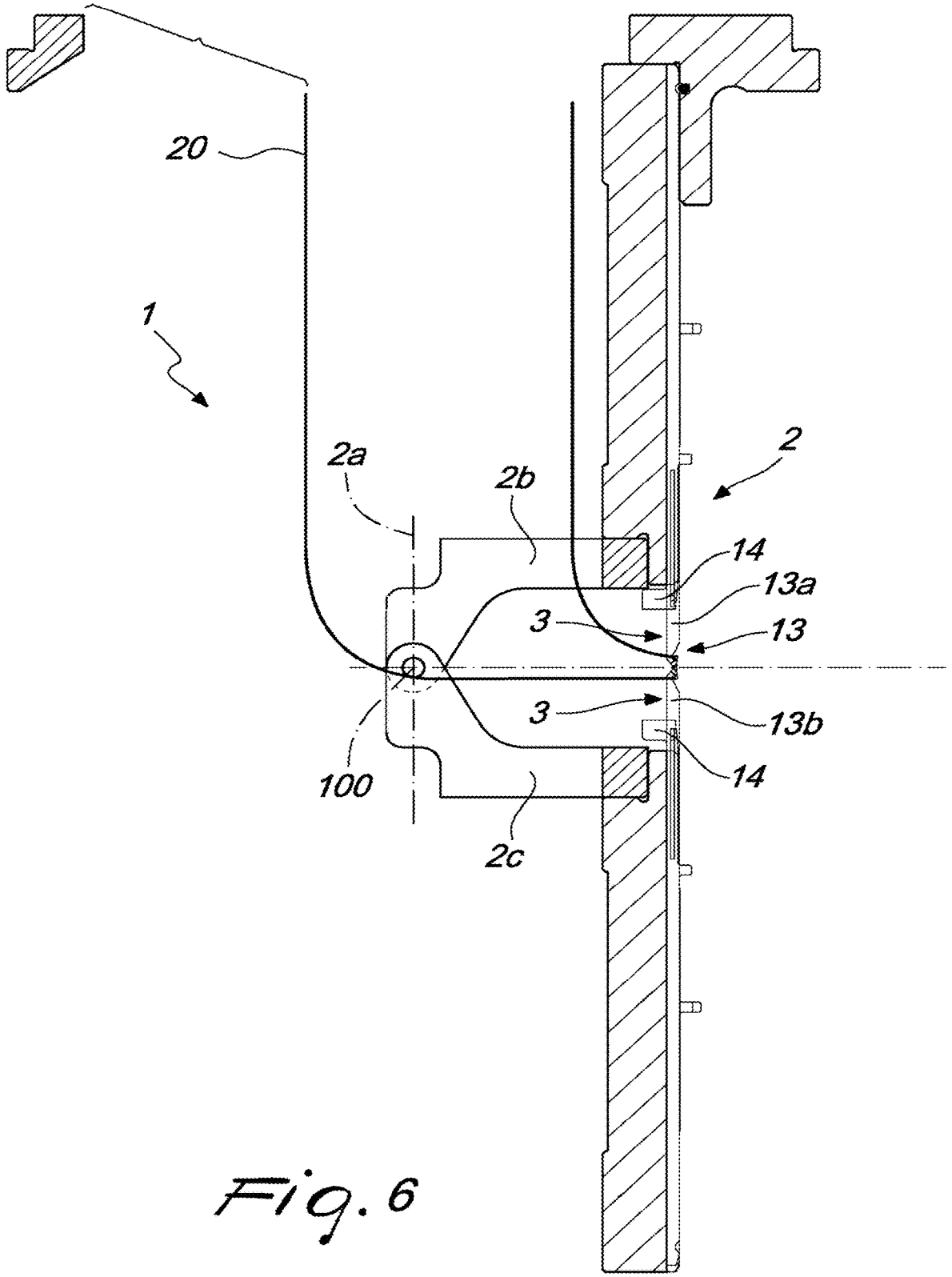
FIG. 6 is a diametrical sectional view of the removal device with the two annular portions in the sewing condition.

At this point (FIG. 4), the removal body 2 is raised in order to move away from the needle cylinder 42 and the tubular manufacture 20 is turned inside out (FIG. 5).

At this point (FIG. 6), the annular portions are made to perform a relative rotation about the oscillation axis 100 in order to move from the removal condition to the sewing condition.

Figure 7:
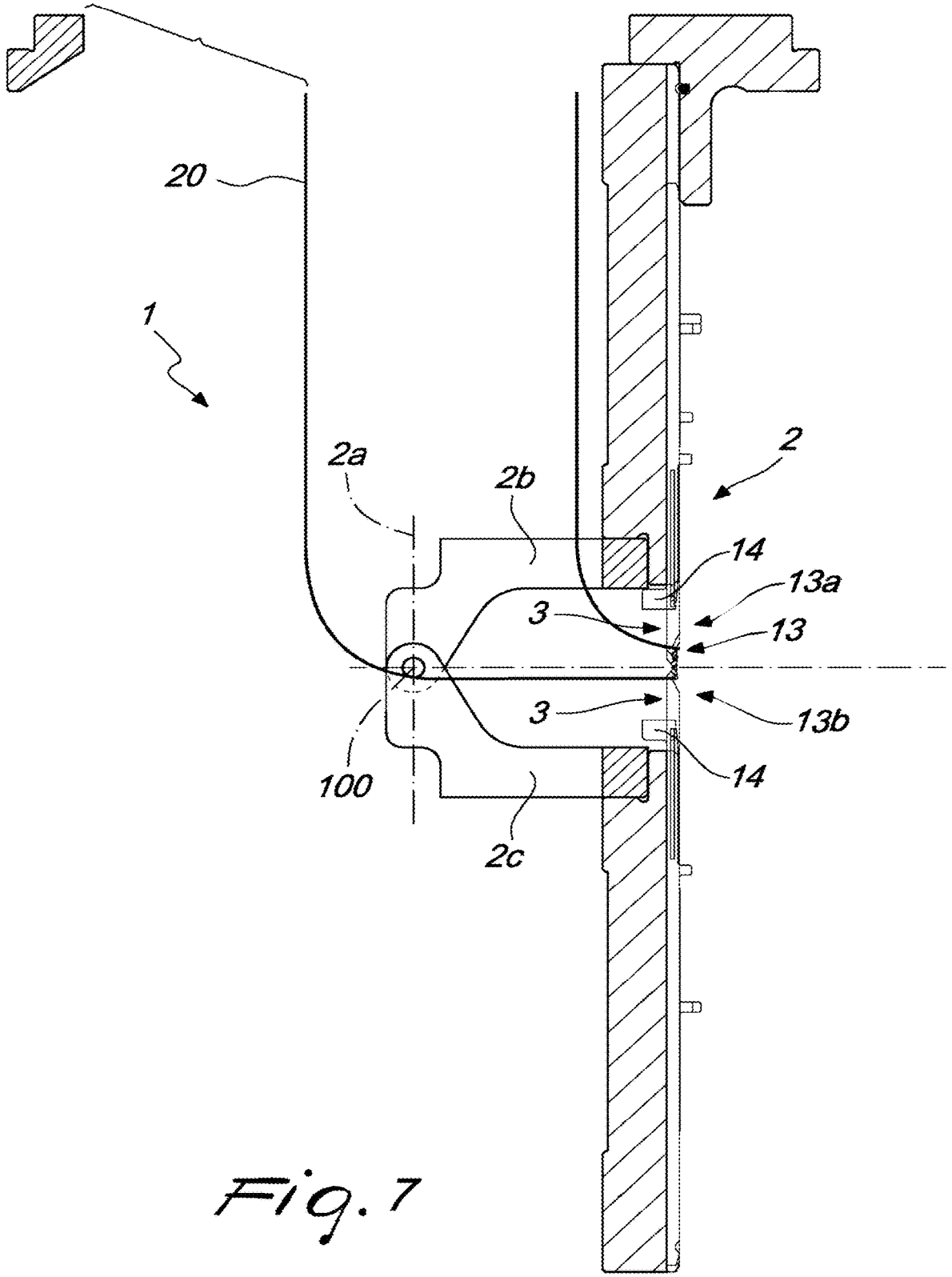
FIG. 7 is a diametrical sectional view of the removal device with the two annular portions in the sewing condition during the step of disengaging the loop of knitting from the hook-shaped portion of the first removal element.
Figure 8:
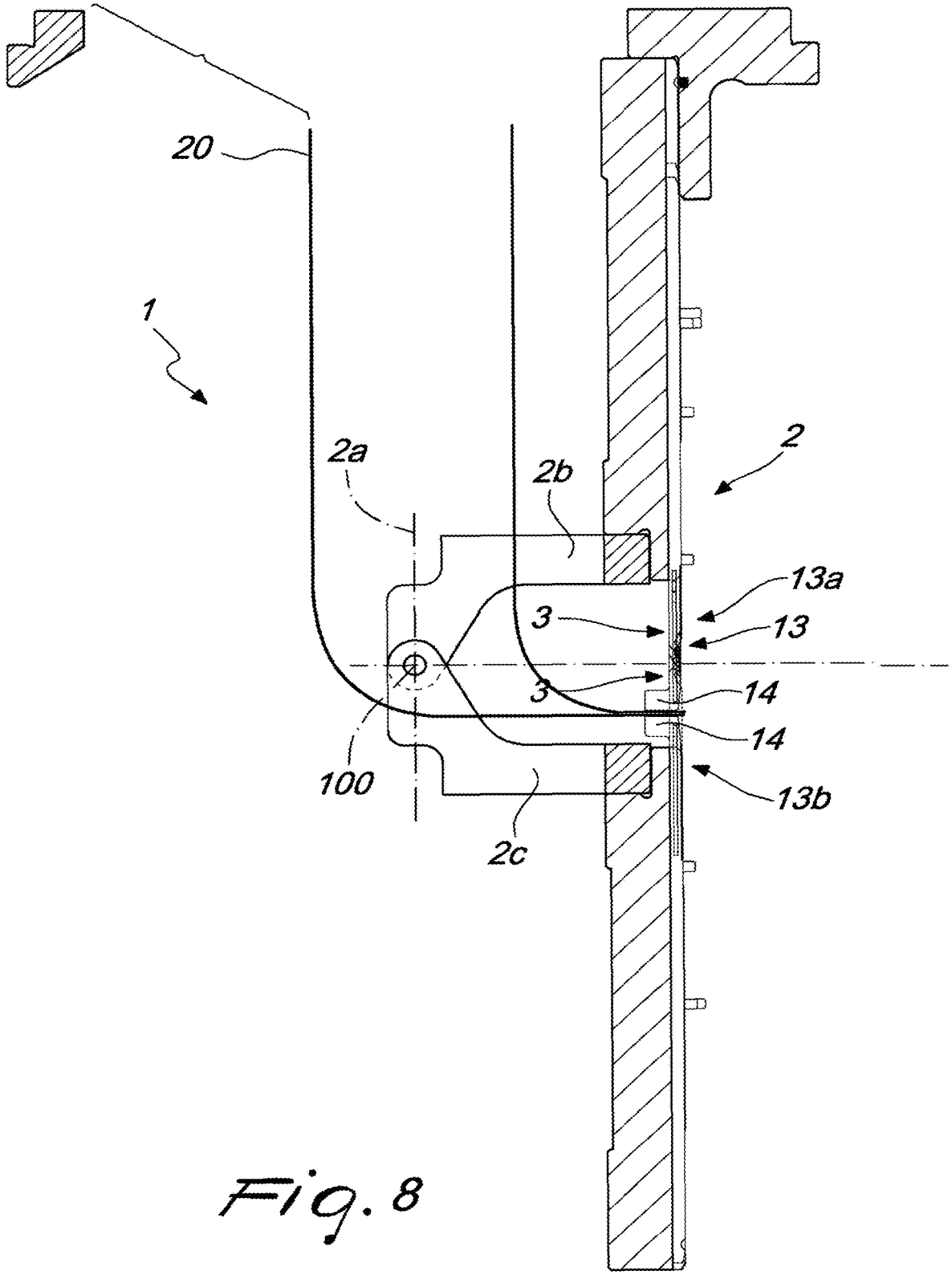
FIG. 8 is a diametrical sectional view of the removal device with the two annular portions in the sewing condition during the step of disengagement of the loop of knitting from the hook-shaped portion of the second removal element.

The second removal element 13*b* of the first annular portion 2*b* rises and unseats the loop of knitting from the respective hook-shaped portion 13*c* (FIG. 7).

The transfer elements 14 associated with the first removal elements 13*a* are lowered (FIG. 8), transferring the loops of knitting toward the second removal element 13*b*.

Figure 9:
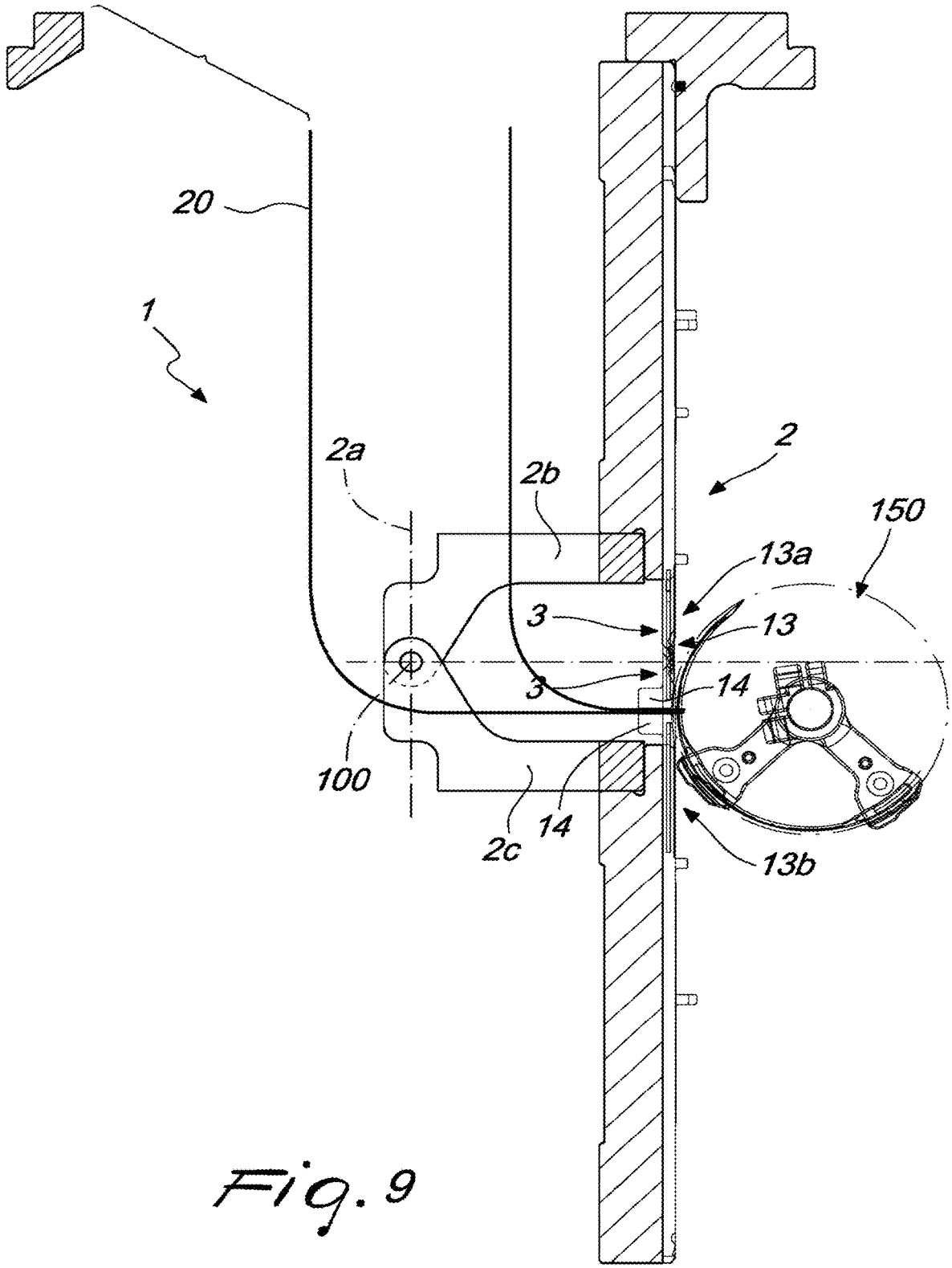
FIG. 9 is a diametrical sectional view of the removal device with the two annular portions in the sewing condition during the sewing step.
Figure 10:
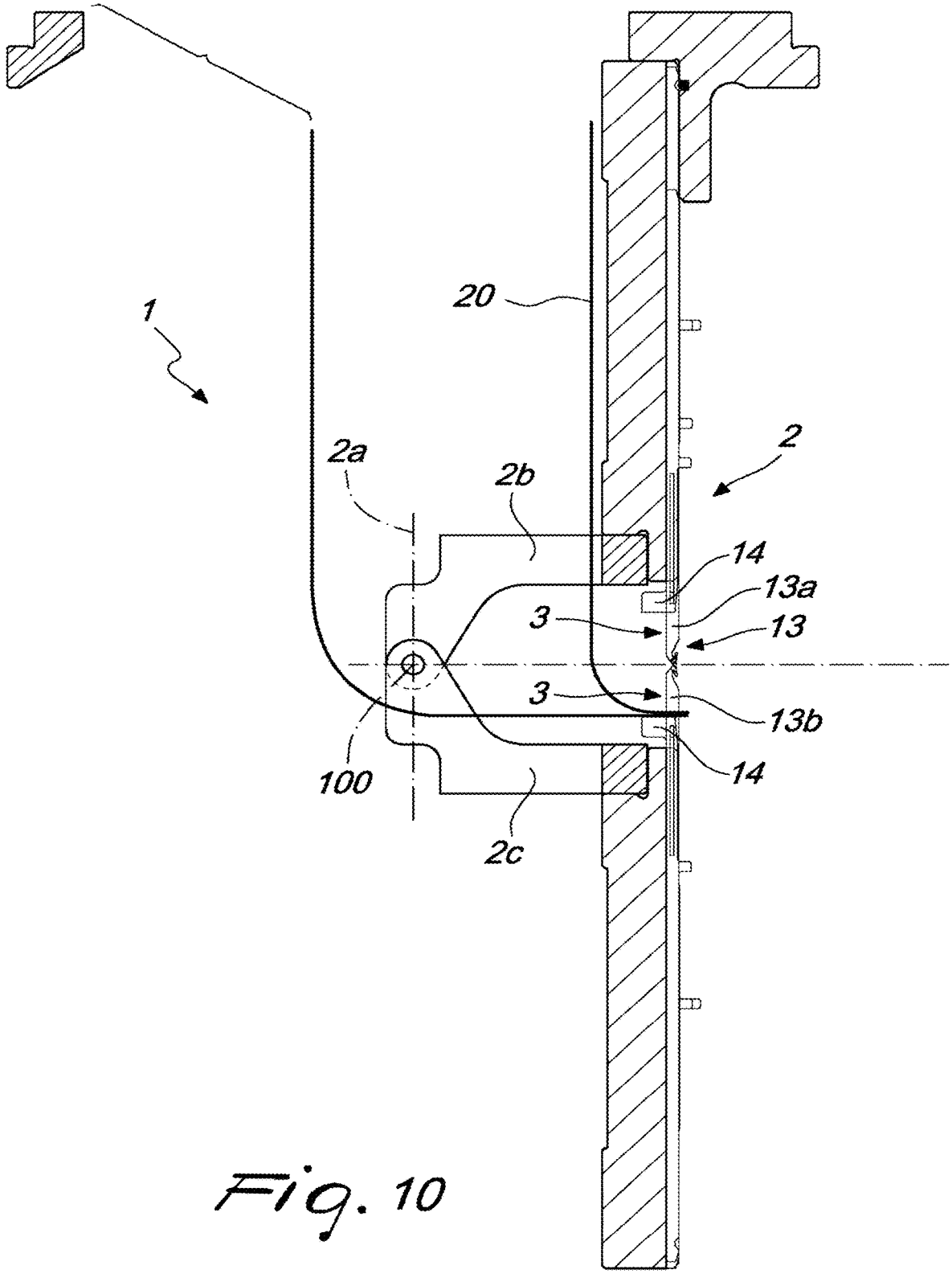
FIG. 10 is a diametrical sectional view of the removal device with the two annular portions in the sewing condition at the end of the sewing step.
Figure 11:
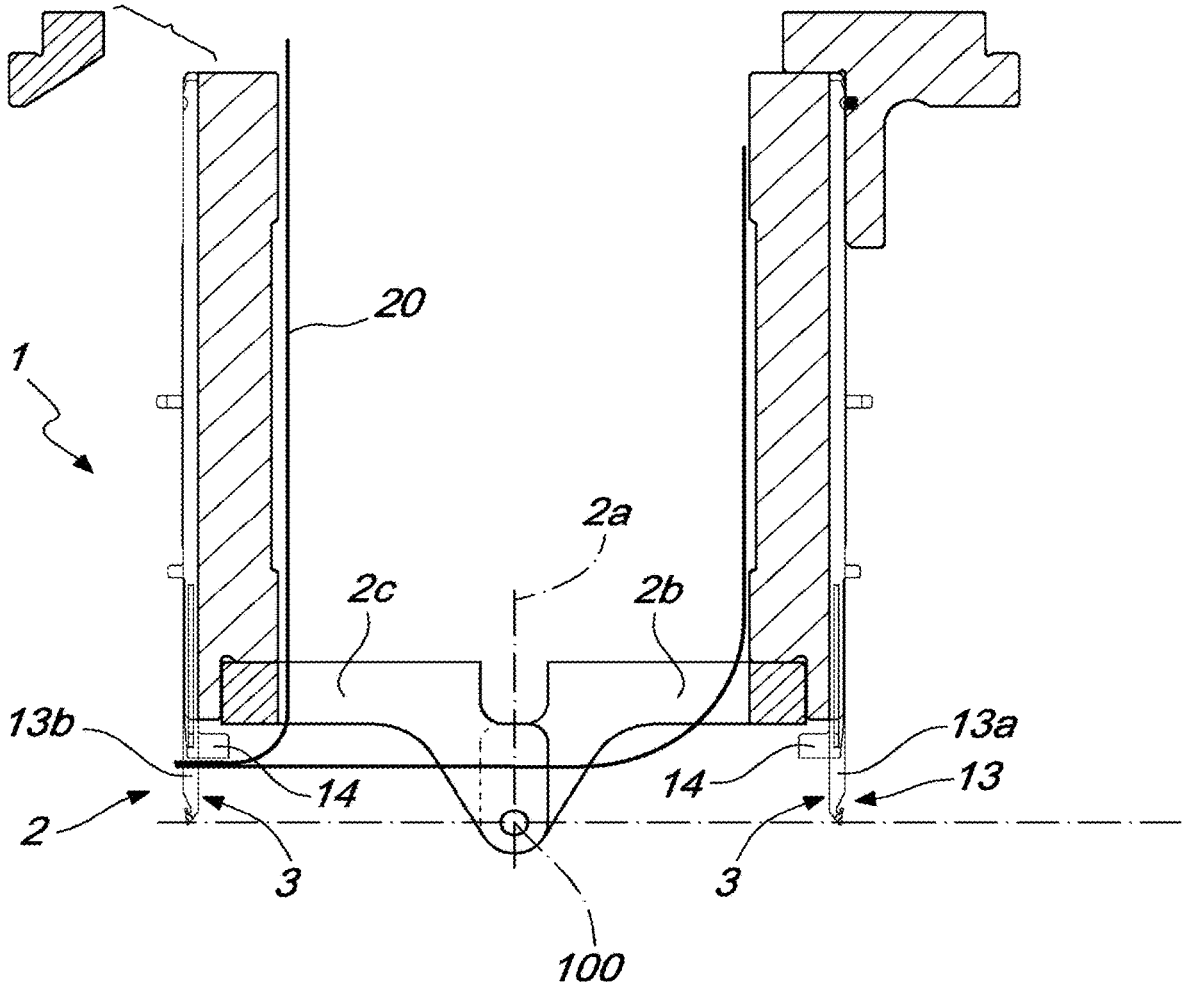
FIG. 11 is a diametrical sectional view of the removal device with the two annular portions in the removal condition.

The sewing unit 50 then proceeds to sew the loops of knitting (FIG. 9).

At this point (FIG. 10), the transfer elements 14 associated with the first removal elements 13*a* rise, releasing the tubular element.

In practice it has been found that the invention achieves the intended aim and objects by providing a removal device that is extremely practical and effective.

The invention thus conceived is susceptible of numerous modifications and variations, all of which are within the scope of the appended claims; all the details may furthermore be replaced with other technically equivalent elements.

In practice, the materials used, as long as they are compatible with the specific use, as well as the contingent shapes and dimensions, may be any according to the requirements and the state of the art.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A removal device for removing a knitted tubular manufacture from a circular knitting machine for hosiery, comprising an annular removal body which supports a plurality of removal members arranged around an axis of said removal body, said removal body being configured to be arranged coaxially around a needle cylinder of a circular knitting machine for hosiery with each one of said removal members arranged so as to correspond to a respective needle of a plurality of needles of the circular knitting machine, wherein said removal members are supported by a first annular portion and a second annular portion, said first annular portion supporting a plurality of first removal members and said second annular portion supporting a plurality of second removal members, wherein said first annular portion and said second annular portion can rotate with respect to each other about an axis that is substantially perpendicular to the axis of the removal body to pass between a removal condition, in which the removal members are arranged so as to form a circumference that is coaxial with the axis of the removal body, and a sewing condition, in which said plurality of first removal members are adjacent to said plurality of second removal members, each of said first removal members being provided with a first removal element and a second removal element which are arranged side by side and are designed, during removal of a respective loop of knitting from a corresponding needle of the plurality of needles of the circular knitting machine, to be arranged on opposite sides with respect to the corresponding needle, said first and second removal elements forming a removal head which can move with respect to the corresponding needle along a movement direction that is substantially parallel to the axis of said removal body, said first removal element forming, at said removal head, a hook-shaped portion designed to engage and retain the loop of knitting in engagement with the corresponding needle, and said second removal element comprising, at said removal head, an abutment portion which can move, with respect to said hook-shaped portion, in order to disengage from said hook-shaped portion the respective loop of knitting, each of said first removal members comprising at least one transfer element which can move with respect to said removal head and is designed to transfer the loop of knitting disengaged from the hook-shaped portion of each of said first removal members to a respective second removal member of said plurality of second removal members when said first annular portion and said second annular portion are in the sewing condition.

2. The removal device according to claim 1, wherein said removal body can rotate on command about the axis thereof at a same angular velocity as said needle cylinder during steps of engagement of each of said first and second removal members with the corresponding needle.

3. The removal device according to claim 1, wherein each of said second removal members comprises a removal head, the removal head comprising a second removal element wherein the second removal element has a hook-shaped portion designed to engage and retain the loop of knitting in engagement with the corresponding needle of a plurality of needles of the circular knitting machine.

4. The removal device according to claim 3, wherein said second removal members comprising the second removal elements can move with respect to the respective needles of the plurality of needles of the circular knitting machine along a movement direction that is substantially parallel to the axis of said removal body.

5. The removal device according to claim 1, wherein said at least one transfer element comprises a pusher lamina arranged between said first removal element and second removal element of each first removal member of said plurality of first removal members.

6. The removal device according to claim 3, wherein each of said second removal members comprise a transfer element which can move with respect to the respective removal head of each of said second removal members and is designed to act as abutment for the respective loop of knitting in disengagement from the hook-shaped portion of the removal head of each of said second removal members.

7. The removal device according to claim 1, further comprising selective actuation means for movement of said first and second removal members.

8. The removal device according to claim 1, wherein said first and second removal elements arranged side by side can move away from and toward each other along a direction that is substantially tangential with respect to the axis of said removal body following engagement with the respective needle.

* * * * *